US010948251B1

(12) United States Patent
Hopkins et al.

(10) Patent No.: US 10,948,251 B1
(45) Date of Patent: Mar. 16, 2021

(54) SEMI-AUTOMATIC PISTOL SLIDE PULL ATTACHMENT

(71) Applicants: Charles Tyler Hopkins, Green Cove Springs, FL (US); Charles Anthony Hopkins, Green Cove Springs, FL (US)

(72) Inventors: Charles Tyler Hopkins, Green Cove Springs, FL (US); Charles Anthony Hopkins, Green Cove Springs, FL (US)

( * ) Notice: Subject to any disclaimer, the term of this patent is extended or adjusted under 35 U.S.C. 154(b) by 0 days.

(21) Appl. No.: 16/682,136

(22) Filed: Nov. 13, 2019

(51) Int. Cl.
*F41A 3/72* (2006.01)
*F41A 3/10* (2006.01)
*F41C 23/10* (2006.01)

(52) U.S. Cl.
CPC *F41A 3/72* (2013.01); *F41A 3/10* (2013.01); *F41C 23/10* (2013.01)

(58) Field of Classification Search
CPC .... F41A 3/72; F41A 3/10; F41C 23/10; F41C 23/00; F41C 27/00
See application file for complete search history.

(56) References Cited

U.S. PATENT DOCUMENTS 8,312,803 B2 * 11/2012 Oz ..... F41A 19/34 89/1.4
8,468,194 B2 6/2013 Meller et al.
8,468,734 B2 * 6/2013 Meller ..... F41C 3/00 42/90
D697,997 S * 1/2014 Grossman ..... D22/108
D697,998 S * 1/2014 Grossman ..... D22/108
D702,308 S * 4/2014 Glock ..... D22/108
8,782,937 B2 * 7/2014 Grossman ..... F41A 17/46 42/1.01
D724,689 S * 3/2015 Sui ..... D22/108
9,194,654 B1 * 11/2015 Viani ..... F41C 27/00
D757,881 S * 5/2016 Biedenbach ..... D22/108
D757,882 S * 5/2016 Biedenbach ..... D22/108
D767,075 S * 9/2016 Grossman ..... D22/108
9,546,843 B2 * 1/2017 Sroufe ..... F41A 3/72
9,587,905 B1 * 3/2017 Biedenbach ..... F41C 23/16
9,677,847 B2 * 6/2017 Finsand ..... F41C 33/008
9,733,043 B1 * 8/2017 Cohen ..... F41C 27/00
9,995,544 B1 * 6/2018 Akimov ..... F41C 3/00
2009/0162596 A1 * 6/2009 Rios ..... A63B 60/14 428/45
2009/0162651 A1 * 6/2009 Rios ..... B32B 27/12 428/354

(Continued)

*Primary Examiner* — Joshua E Freeman
(74) *Attorney, Agent, or Firm* — Barlow, Josephs & Holmes, Ltd.

(57) ABSTRACT

A slide pull attachment for use on a slide of a semi-automatic pistol comprises a flexible, unitary sheet member having a longitudinal centerline and a lateral centerline, an adhesive material disposed on a rear surface of the sheet member for adhering the sheet member to a slide, and a contoured pull tab projecting upwardly from an upper surface of the sheet member. The contoured pull tab is located rearward of the lateral centerline and adjacent a first side edge of the sheet member. The attachment further comprises a plurality of spaced, parallel relief grooves extending longitudinally in the upper surface of the sheet member between a rearward edge of the sheet member and a forward edge thereof, and a plurality of spaced, parallel relief grooves extending laterally in the upper surface of the sheet member from a second side edge of the sheet member towards the first side edge.

8 Claims, 4 Drawing Sheets

(56) References Cited

U.S. PATENT DOCUMENTS

| | | | | |
|---|---|---|---|---|
| 2010/0183814 | A1* | 7/2010 | Rios | C08L 83/04<br>427/387 |
| 2011/0088539 | A1 | 4/2011 | Oz | |
| 2011/0154710 | A1 | 6/2011 | Hatfield | |
| 2014/0047753 | A1* | 2/2014 | Grossman | F41A 3/66<br>42/72 |

* cited by examiner

SEMI-AUTOMATIC PISTOL SLIDE PULL ATTACHMENT

BACKGROUND OF THE DISCLOSURE

The present invention generally relates to semi-automatic pistols, and more specifically to a flexible slide pull attachment that can be adapted for use with almost any semi-automatic pistol.

Semi-automatic firearms are designed to harness the recoil energy from discharge of a round to force the slide rearwardly, automatically ejecting the shell casing and loading a subsequent round. However, when the firearm is empty, the slide must be manually pulled back against the recoil spring and released. Otherwise known as "racking" the slide.

Racking the slide on a semi-automatic pistol requires sufficient hand strength to counteract the compression force of the recoil spring. To rack the slide, the user must hold the pistol frame in one hand and grasp the slide with the other hand and pull or push rearwardly. For a right-handed shooter this usually means gripping the frame with their dominant right hand and racking the slide with the non-dominant left hand, which is usually the weaker and less dexterous hand. Grasping the slide is sometimes accomplished between the thumb and forefinger grasping and pulling the rear end of the slide, which may be provided with serrations to enhance grip friction. For others, grasping the slide may be accomplished with the palm over the top of the slide, thumb and forefinger grasping at the rear and pushing the slide rearwardly. Either method requires significant grip strength and hand strength.

There is thus an issue with shooters that have compromised grip and/or hand strength, such as the elderly, persons with hand injuries that have insufficient dexterity, and persons who are limited to the use on one hand. Accordingly, there is a need in the industry for improved accessories that can assist with use and operation of semi-automatic pistols.

SUMMARY OF THE INVENTION

An exemplary embodiment of the present invention comprises a slide pull attachment for installed use on a slide of a semi-automatic pistol comprising a flexible, unitary sheet member having a longitudinal centerline and a lateral centerline, an adhesive material disposed on a rear surface of the sheet member for adhering the sheet member to a slide, and a contoured pull tab projecting upwardly from an upper surface of the sheet member. The contoured pull tab is located rearward of the lateral centerline and adjacent a first side edge of the sheet member. The attachment further comprises a plurality of spaced, parallel relief grooves extending longitudinally in the upper surface of the sheet member between a rearward edge of the sheet member and a forward edge of the sheet member, and a plurality of spaced, parallel relief grooves extending laterally in the upper surface of the sheet member from a second side edge of the sheet member towards the first side edge.

In use, the slide pull attachment is adhered to a rear portion of a slide adjacent to and forward of the rear sight with the contoured pull tab located on a side surface of the slide. The longitudinal relief grooves permit the sheet member to flex and wrap over a top surface of the slide and conform to the slide outer surface. The sheet member has a thickness that does not interfere with the rear sight picture.

BRIEF DESCRIPTION OF THE DRAWINGS

Exemplary embodiments will now be described further by way of example with reference to the following examples and figures, which are intended to be illustrative only and in no way limiting upon the scope of the disclosure.

DETAILED DESCRIPTION OF THE EXEMPLARY EMBODIMENTS

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Figure 9:
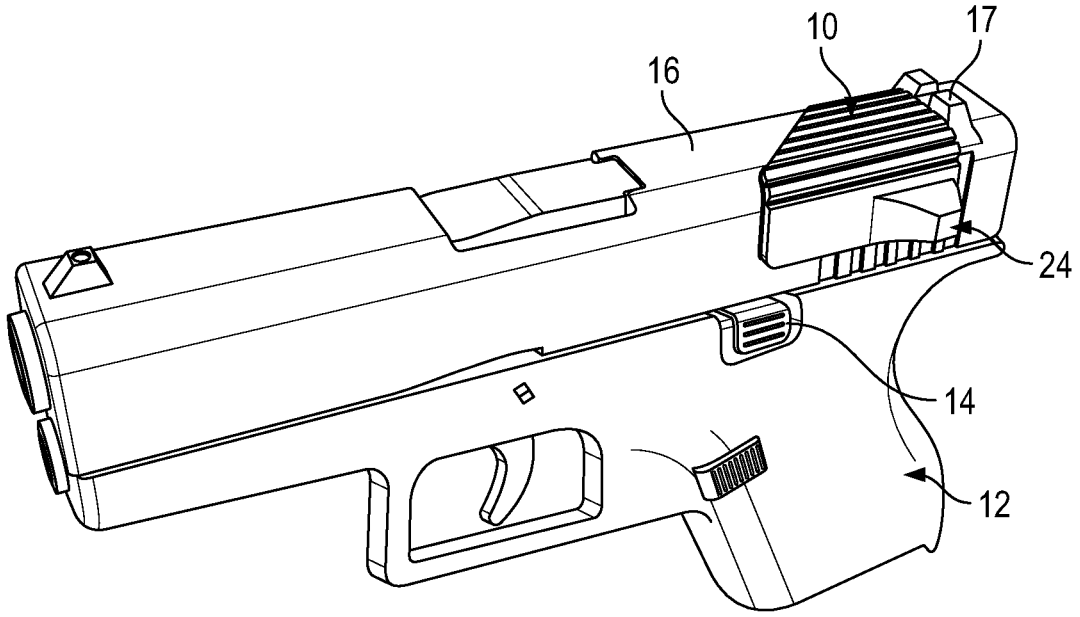
FIG. 9 is an installed view.

Now referring to the drawings, an exemplary embodiment of the present slide pull attachment is shown and generally indicated at 10 in FIGS. 1-9. Referring briefly to FIG. 9, a semi-automatic pistol is generally indicated at 12 comprising a pistol frame 14 and a slide 16.

The slide pull attachment 10 generally comprises a flexible, unitary sheet member 18 having a longitudinal centerline (A) and a lateral centerline (B) which roughly divides the sheet 18 into four quadrants. The unitary sheet member 18 is preferably molded from a flexible polymer material which is flexible enough to bend but also rigid enough to provide a satisfactory leverage point to pull the slide when installed.

In order to adhere the sheet member 18 to the outer surface of the pistol slide 16, an adhesive material 20 is disposed on a rear surface of the sheet member 18. The adhesive material 20 may be any suitable adhesive, such as a contact adhesive, capable of securely fastening the sheet member 18 in position and which is generally not water soluble. Nevertheless, the adhesive material 20 should be soluble with a solvent to remove the sheet member 18 and any remaining residue after removal. A release sheet(s) 22 may cover the adhesive material 20 during manufacture and shipping (See FIG. 4). The release sheet(s) 22 is/are removed prior to installation as known in the art.

Figure 1:
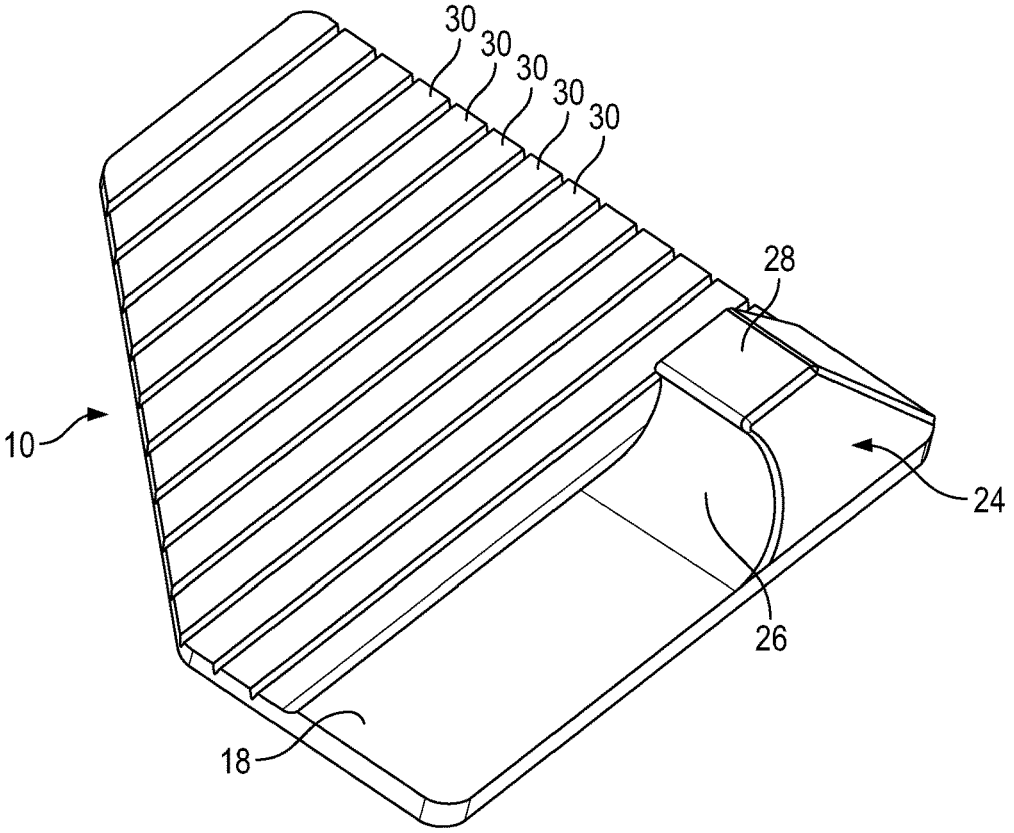
FIG. 1 is a perspective view of an exemplary slide pull attachment in accordance with the present invention.
Figure 2:
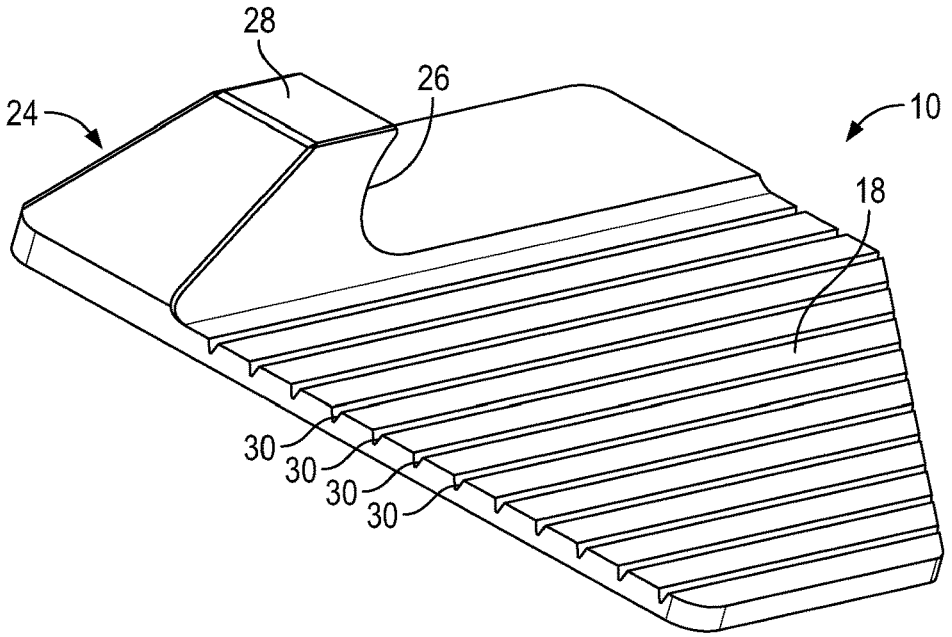
FIG. 2 is another perspective view thereof.
Figure 3:
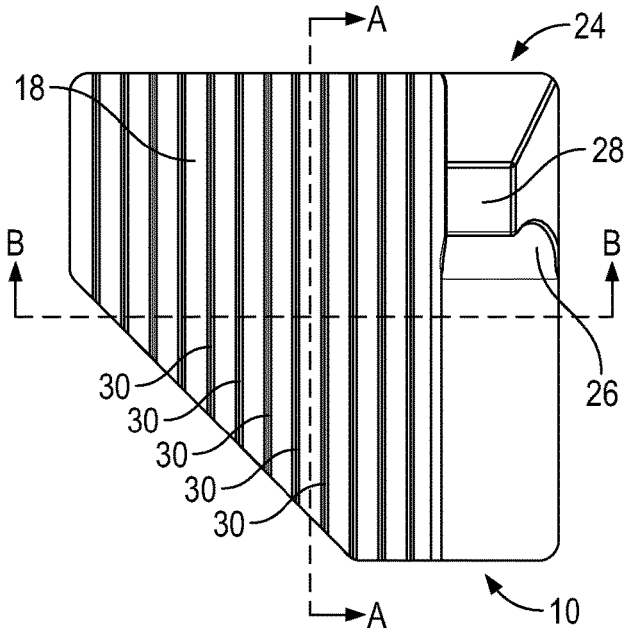
FIG. 3 is a top view thereof.
Figure 4:
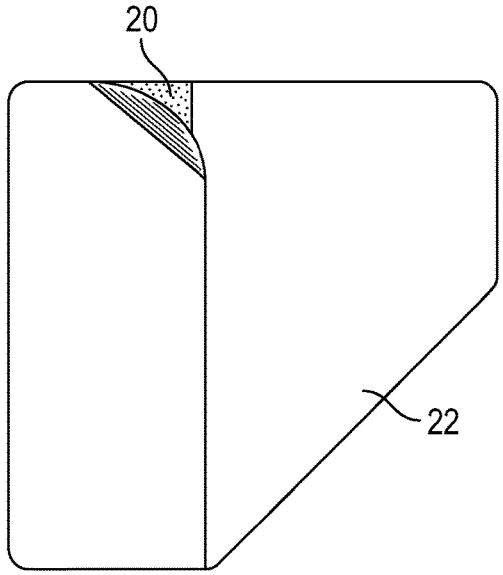
FIG. 4 is a bottom view thereof.
Figure 5:
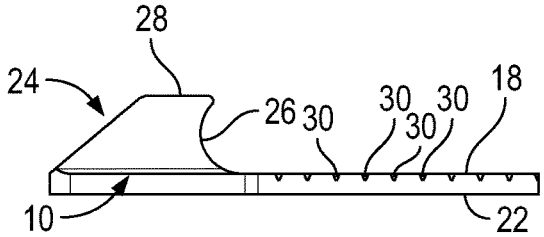
FIG. 5 is a left side view thereof.
Figure 6:
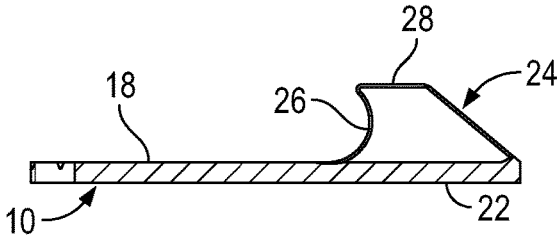
FIG. 6 is a right side view thereof.
Figure 7:
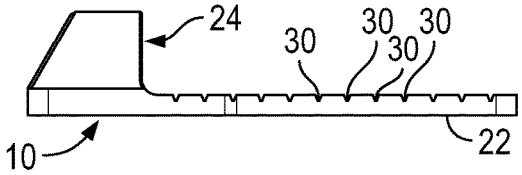
FIG. 7 is a rear view thereof.
Figure 8:
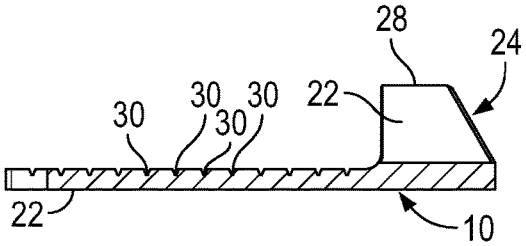
FIG. 8 is a front view thereof.

In accordance with the teachings of the invention, a contoured pull tab 24 projects upwardly from an upper surface of the sheet member 18. Referring to FIGS. 1-3, the contoured pull tab 24 is located rearward of the lateral centerline and adjacent a first side edge of the sheet member 18. For a right-handed version as illustrated, this generally places the pull tab 24 in a location where it will sit on the left side surface of the slide 16 when installed (See FIG. 9). While a right-handed version is illustrated, the various features as described could be reversed to provide left-handed version (now shown). The contoured pull tab 24 is generally contoured with an arcuate sloping pull surface 26, which curves upwardly from the upper surface of the sheet member rearward to a terminal upper plateau 28 adjacent a rear edge of the sheet member 18. The curved pull surface 26 provides a leverage point for the user's forefinger or thumb depending on the grip used to "rack" the slide 16. The curved contour 26 conforms to the shape of the user's fingers and provides increased leverage surface area to facilitate racking of the slide 16. Additionally, if the user is limited to one hand operation, the pull tab 24 can be engaged with the edge of a stationary object, such as a table or wall and used to rack the slide 16 with only one hand on the pistol frame 14.

The slide pull attachment 10 further comprises a plurality of spaced, parallel relief grooves 30 extending longitudinally in the upper surface of the sheet member 18 between a rearward edge of the sheet member and a forward edge of the sheet member. These longitudinal relief grooves 30 permit the sheet member 18 to flex and bend at locations parallel to the longitudinal center (A) so that the sheet member 18 can wrap from the side surface of the slide 16 over the top surface of the slide 16 and closely conform to the slide outer surface. Referring back to FIG. 9, the pull attachment 10 is illustrated in an installed position as described hereinabove. The closely spaced relief grooves 30 allow the sheet member 18 to accommodate a wide variety of chamfered edge surfaces, slide widths, slide heights and curvatures which vary from pistol to pistol and thus permit the sheet 18 to universally fit a majority of the semi-automatic pistol configurations on the market. In this regard, the pull attachment 10 may be located in any desirable location forward or rearward on the slide as well as toward either the upper or lower edge.

In use, the slide pull attachment 10 is adhered to a rear portion of a slide 16 adjacent to and forward of the rear sight 17 with the contoured pull tab 24 located on a side surface of the slide 16. The sheet member 18 has a thickness that does not interfere with the rear sight picture of conventional rear sights 17.

Figure 10:
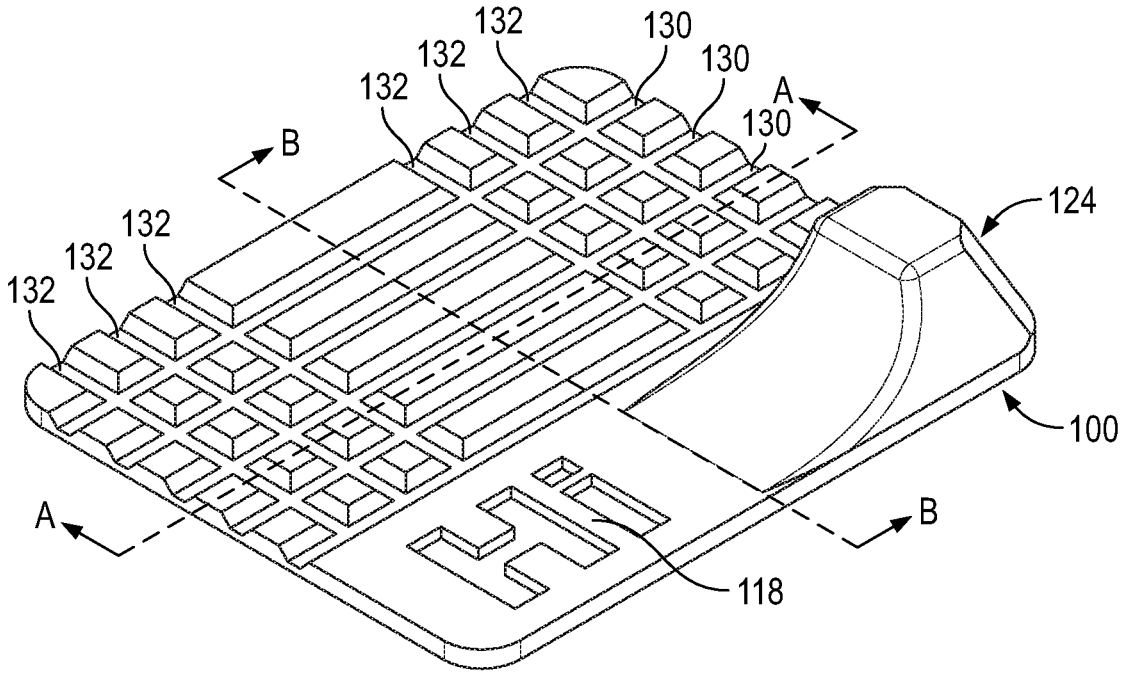
FIG. 10 is a perspective view of another exemplary embodiment.
Figure 11:
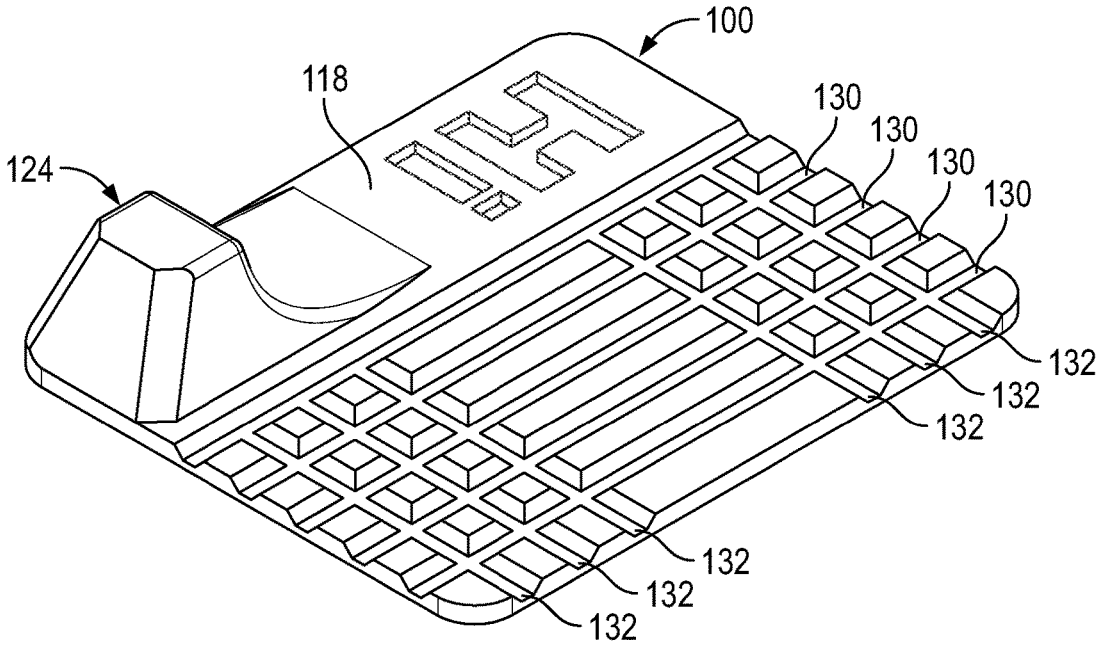
FIG. 11 is another perspective view thereof.
Figure 12:
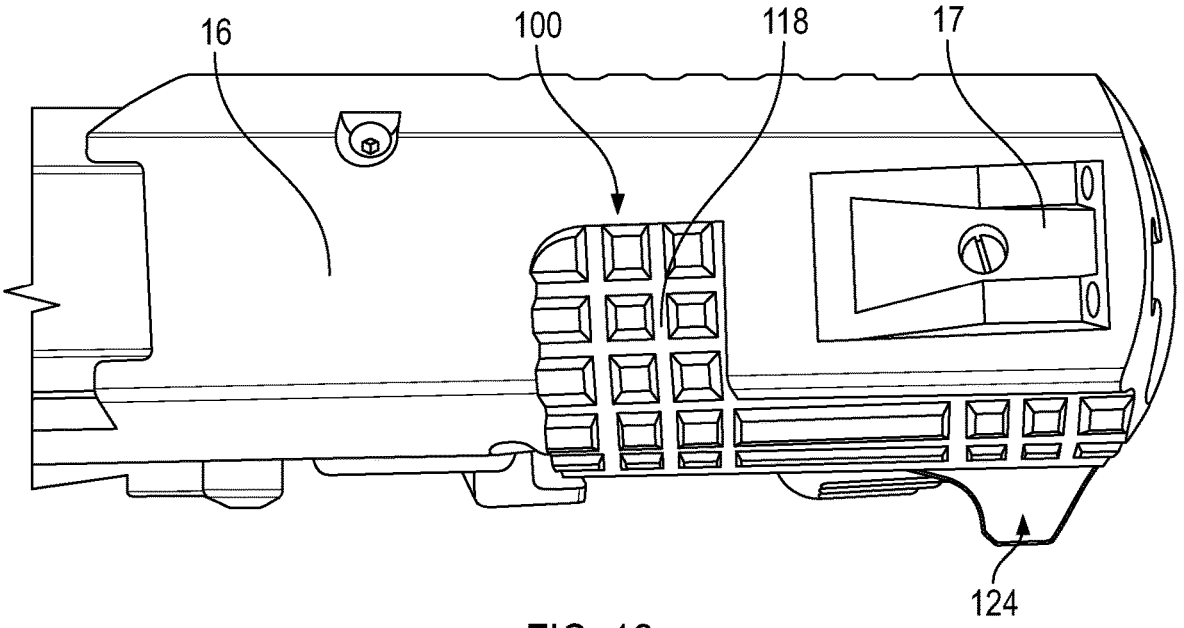
FIG. 12 is an installed view showing a portion of the sheet trimmed to fit around the rear right.

Referring now to FIGS. 10-12, another exemplary embodiment is illustrated and generally indicated at 100. The pull attachment 100 is essentially the same as the previously described attachment 10 except in the configuration of the relief grooves in the upper surface of the sheet. Generally, the slide pull attachment 100 comprises a sheet member 118, with an adhesive material (not shown), release sheets (not shown) and pull tab 124. As seen in FIGS. 10-11, the sheet 118 includes a plurality of parallel longitudinal relief grooves 130 which function the same as previously described hereinabove. The slide pull attachment 100 still further comprises a plurality of spaced, parallel lateral relief grooves 132 extending laterally in the upper surface of the sheet member 118 from a second side edge of the sheet member towards the first side edge. These lateral relief grooves 132 provide frictional gripping surface as well as reduced thickness areas which can permit the sheet member 118 to be trimmed to fit other projecting features on the outer surface of the slide 16 if needed. This would include providing the ability to trim the sheet member 118 to fit around enlarged rear sights or red dot sight platforms (See FIG. 12).

It can therefore be seen that the exemplary embodiments described herein provide a universal slide pull attachment that is simple to install and that exhibits a high degree of functional assistance. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A slide pull attachment for installed use on a slide of a semi-automatic pistol comprising:

a flexible, unitary sheet member having a longitudinal centerline and a lateral centerline, said flexible, unitary sheet member being molded from a flexible polymer material;

an adhesive material disposed on a rear surface of said sheet member for adhering said sheet member to a slide;

a contoured pull tab projecting upwardly from an upper surface of said sheet member and located rearward of the lateral centerline and adjacent a first side edge of said sheet member;

a plurality of spaced, parallel relief grooves formed in the upper surface of said sheet member and extending between a rearward edge of said sheet member and a forward edge of said sheet member; and said slide pull attachment being adhered to a rear portion of a slide with the contoured pull tab located on a side surface of the slide, said longitudinal relief grooves allowing said sheet member to flex and wrap over a top surface of said slide and conform to said slide.

2. The slide pull attachment of claim 1 further including a removable release sheet overlaying said adhesive material to be removed prior to installation.

3. The slide pull attachment of claim 1 wherein said contoured pull tab is contoured with a slope curving upwardly from said upper surface of said sheet member rearward to a terminal upper plateau adjacent a rear edge of said sheet member.

4. The slide pull attachment of claim 2 wherein said contoured pull tab is contoured with a slope curving upwardly from said upper surface of said sheet member rearward to a terminal upper plateau adjacent a rear edge of said sheet member.

5. The slide pull of claim 1 further comprising a plurality of spaced, parallel relief grooves formed in the upper surface of said sheet member and extending from a second side edge of the sheet member towards said first side edge.

6. The slide pull attachment of claim 5 further including a removable release sheet overlaying said adhesive material to be removed prior to installation.

7. The slide pull attachment of claim 6 wherein said contoured pull tab is contoured with a slope curving upwardly from said upper surface of said sheet member rearward to a terminal upper plateau adjacent a rear edge of said sheet member.

8. The slide pull attachment of claim 5 wherein said contoured pull tab is contoured with a slope curving upwardly from said upper surface of said sheet member rearward to a terminal upper plateau adjacent a rear edge of said sheet member.

* * * * *